United States Patent [19]

Stein et al.

[11] Patent Number: 5,028,245

[45] Date of Patent: Jul. 2, 1991

[54] VACUUM CLEANER INCLUDING FILTER BAG MOUNTING APPARATUS

[75] Inventors: Klaus Stein; Heinz Kaulig, both of Velbert, Fed. Rep. of Germany

[73] Assignee: Stein & Co. GmbH, Verbelt, Fed. Rep. of Germany

[21] Appl. No.: 466,040

[22] Filed: Jan. 17, 1990

[30] Foreign Application Priority Data

May 9, 1989 [DE] Fed. Rep. of Germany ..... 3915084

[51] Int. Cl.[5] ..... A47L 9/00

[52] U.S. Cl. ..... 55/373; 15/350; 55/374; 55/473

[58] Field of Search ..... 15/350; 55/373, 374, 55/378, 473

[56] References Cited

U.S. PATENT DOCUMENTS 4,262,384 4/1981 Bowers ..... 55/473
4,452,618 6/1984 Kuplas ..... 55/473
4,591,369 5/1986 Stewart, Sr. et al. ..... 55/374
4,699,641 10/1987 Barnes, Jr. ..... 55/374
4,705,547 11/1987 Rotola, Jr. et al. ..... 55/378

*Primary Examiner*—Jay H. Woo
*Assistant Examiner*—C. Scott Bushey
*Attorney, Agent, or Firm*—Thomas N. Ljungman

[57] ABSTRACT

The invention relates to a vacuum cleaner having a removable or pivoting cover on the housing of the vacuum cleaner to hold a filter bag. In the cover, there is a sliding, adjustable guide element which holds a filter bag reinforcement plate having a filler opening. When the guide element is adjusted by an activating element, the reinforcement plate is locked with the cover by appropriate elements, and is engaged with its filler opening over a corresponding filler tube on the housing, so that the cover can be locked in the housing by the reinforcement plate.

15 Claims, 10 Drawing Sheets

VACUUM CLEANER INCLUDING FILTER BAG MOUNTING APPARATUS

BACKGROUND OF THE INVENTION

1. Field of the Invention

This invention relates to a vacuum cleaner including an apparatus to mount a filter bag in the vacuum cleaner with a dust chamber closed by a cover which can be pivoted or removed. The filter bag has a reinforcement plate which serves as a filter mounting plate, corresponding to which there is a filler opening and a filler tube.

2. Description of the Prior Art

Vacuum cleaners conventionally use cloth or paper bags to capture the dirt picked up. In practice, the process of changing the filter bag is frequently rather difficult and complicated. The result is that filter bags are frequently incorrectly installed, and the dust picked up by the vacuum cleaner is not deposited as intended in the filter bag, but is scattered throughout the filter housing or is expelled with the air blown out of the vacuum cleaner back into the room to be cleaned.

Since vacuum cleaners and brush-type vacuum cleaners are equipped with so-called "flow-through" motors, the dirt not trapped by the filter and bag gets into the motor, where it can cause significant damage. There is an even greater danger if no filter bag is used at all.

OBJECT OF THE INVENTION

The object of the invention is to improve an apparatus of the type described above, to facilitate the correct installation of the filter bag, to guarantee a verification of the operating position of the filter bag and to prevent operation without a filter bag.

SUMMARY OF THE INVENTION

This object is accomplished according to the invention in that the reinforcement plate of the filter bag can be inserted in a guide element located on the cover, which can be adjusted so that the reinforcement plate of the filter bag can be inserted in a guide element located on the cover The guide element can be adjusted from outside when the cover is closed so that it slides by means of a control element to guide the filler tube into the filler opening of the reinforcement plate. The reinforcement plate has locks which can be locked by means of corresponding abutments on the cover during the adjustment and insertion of the filler tube into the filler opening of the reinforcement plate.

This configuration has the advantage that the filter bag with its reinforcement plate can be inserted in the cover when the cover is removed, and can thus can be oriented under acceptable visibility conditions. That prevents errors which can be caused when installing filter bags in a "blind" or hidden condition.

The lifting of the guided reinforcement plate for the introduction of the inlet tube into the opening simultaneously locks the cover, so that it is apparent whether the filler opening of the reinforcement plate is correctly positioned in relation to the filler tube.

In one favorable configuration of the invention, the guide element has mounting rails for the lateral mounting of the reinforcement plate of the filter bag.

To guarantee a proper mounting of the reinforcement plate, the guide element according to the invention has recesses to hold corresponding catches on the inserted end of the reinforcement plate of the filter bag.

A simple interlock between the reinforcement plate and cover is created by the fact that the abutments for the locking lugs of the filter bag reinforcement plate are formed by brackets on the cover.

To provide protection during the individual handling operations, and to verify the correct orientation of the filter bag, the invention proposes that in the guide element there is a control shaft with cams, wherein the shaft is held by a return spring. A cam, by means of the inserted reinforcement plate, rotates the control shaft so that a locking cam releases the cover closing. During the process of closing the cover, the locking cam, by means of a control edge, causes a further rotation of the control shaft to release a lock of the control element to adjust the guide element.

The objects of the invention are provided in a preferred embodiment including a vacuum cleaner having a housing having a lower portion including wheels for movement along a floor. The housing has a handle for producing the movement of the vacuum cleaner along the floor. The housing has a displaceable cover for being displaced to a closed position on the housing for defining a dust chamber therein. An air suction device in the housing is used for drawing air into the dust chamber. The housing has a filler tube for supply of the air to the dust chamber. The filler tube has an end disposed within the dust chamber. A filter bag includes a reinforced plate for installation within the dust chamber. The reinforced plate has a filler opening for receipt of the end of the filler tube therein. The cover has an interior wall with a guide element mounted thereon for movement toward and away from the end of the filler tube when the cover is in the closed position. The reinforced plate can be selectively installed on the guide element in an installed position. The guide element, with the reinforcement plate in the installed position thereon, is for movement toward the end of the filler tube when the cover is in the closed position to cause receipt of the end of the filler tube in the filler opening of the reinforcement plate.

BRIEF DESCRIPTION OF THE DRAWINGS

Embodiments of the invention are schematically illustrated in the accompanying drawings

DESCRIPTION OF THE PREFERRED EMBODIMENTS

Figure 1:
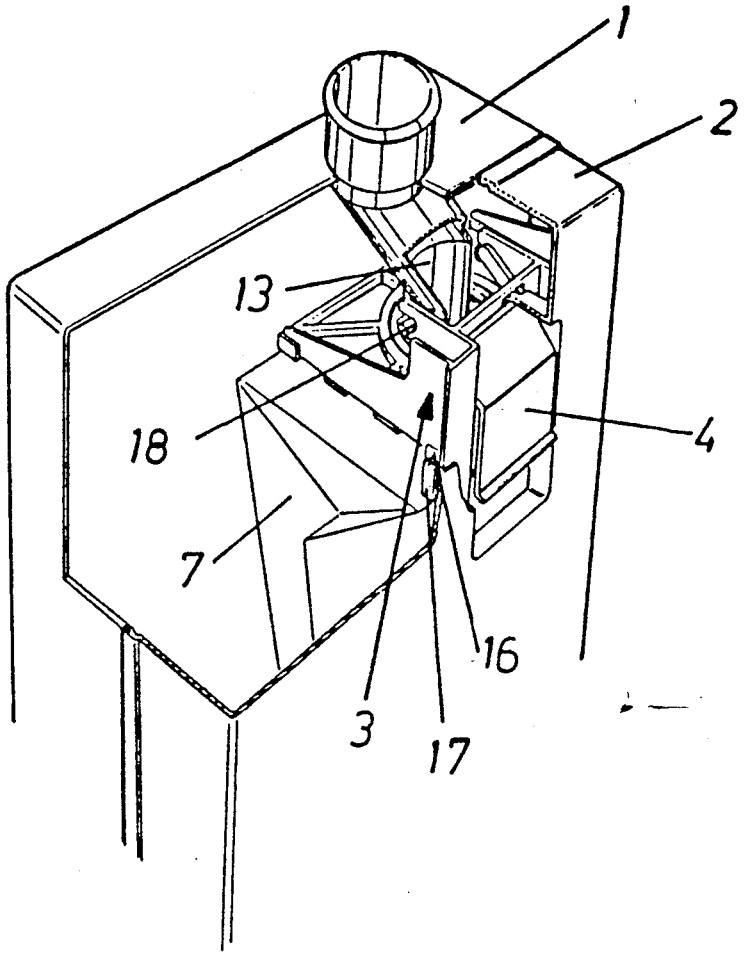
FIG. 1 shows the upper portion of a vacuum cleaner in the working position.
Figure 2:
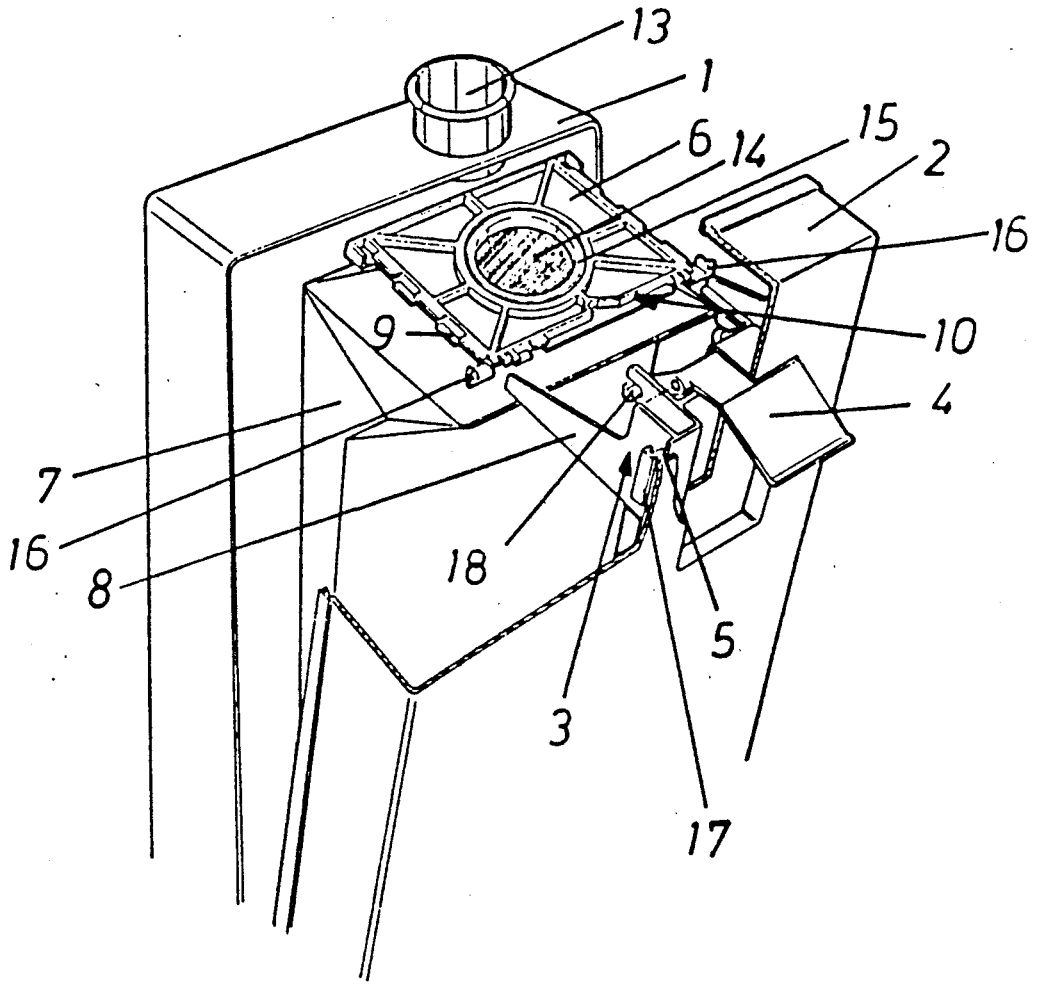
FIG. 2 is an illustration of the same portion, as in FIG. 1, in the position for replacing the filter bag.
Figure 3:
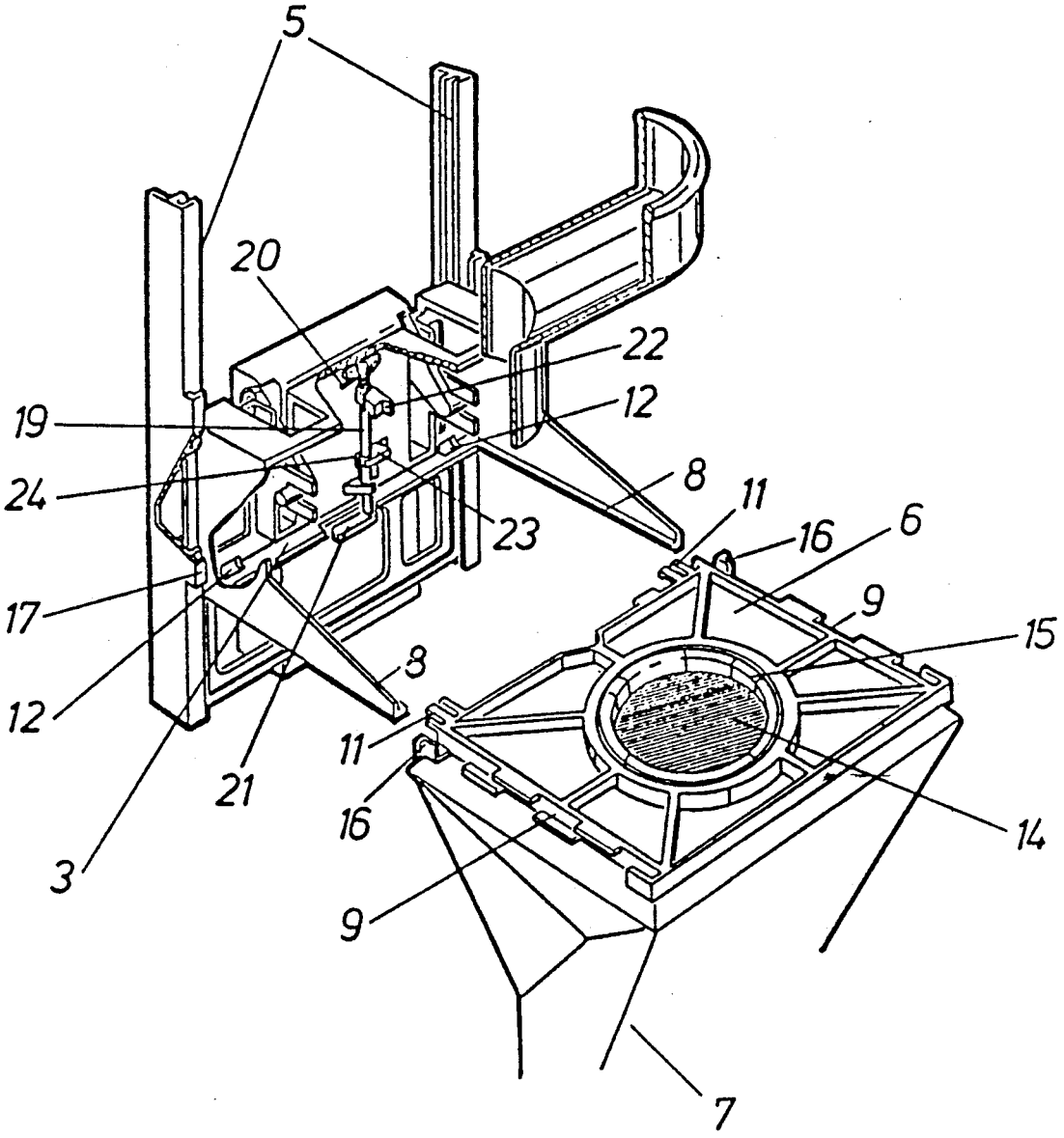
FIG. 3 is an enlarged view of the guide element with the corresponding reinforcement plate of the filter bag in the replacement position.

As seen in FIGS. 1, 2 and 3, the illustrated arrangement comprises essentially a vacuum cleaner having a housing 1 with a removable cover 2, which can be inserted in the lower portion of the housing and is mounted so that it can be pivoted. Air is drawn into the housing 1 by a blower and motor at the bottom of the housing through connecting hose means and a fixed filler tube 13 to create a suction on a filter bag 7 mounted therein. In the cover 2, there is a vertically adjustable guide element 3, which can be displaced from its lower position (FIG. 2) into its upper position (FIG. 1) by means of an externally-operated control element 4 in the form of a mechanical lever. For this purpose, the guide element 3 is mounted so that it can move vertically by means of rails 5 in the cover 2.

The guide element 3 also holds a reinforcement plate 6 of the filter bag 7 and, for that purpose, has mounting rails 8 for the lateral mounting of the reinforcement plate 6. The reinforcement plate 6 has a corresponding mounting groove 9 which is discontinuous in places. This arrangement guarantees a fixed orientation between the reinforcement plate 6 and the guide element 3. As best seen in FIGS. 2 and 3, on the inserted end 10 of the reinforcement plate 6, there are catches 11, corresponding to which there are recesses 12 in the guide element 3 for the corresponding mounting. As a result, the reinforcement plate 6 of the filter bag 7 is precisely positioned and held in the guide element 3 at an installed position.

To transport the dirt picked up by the vacuum cleaner a hose or other device (not shown) is connected to the fixed filler tube 13. The fixed filler tube 13 is rigidly mounted in the housing 1, while the reinforcement plate 6 of the filter bag 7 has a filler opening 14 and a sealing lip 15. The filler opening 14 of the reinforcement plate 6, after the correct insertion into the guide element 3, is thereby a direct extension of the filler tube 13.

The reinforcement plate 6 also has lateral locking lugs 16, which, when installed in the guide element 3, have corresponding brackets 17 on the cover 2, and are engaged with one another when the guide element 3 is displaced upwardly.

As a result of the folding of the control element 4, when the cover 2 is installed and closed, a lever joint 18 displaces the guide element 3 in the rails 5 in the cover 2. As a result, the inserted reinforcement plate 6 with its filler opening 14 and the sealing lip 15 are pushed over the filler tube 13 of the housing 1.

To prevent the cover 2 from being closed when no filter bag 7 is installed at the installed position, and also to check on other functions, there is a control shaft 19 in the guide element 3, held by means of a return spring 20. The control shaft has corresponding cams 21, 22 and 23.

The following measures guarantee safe operation:

1. When the reinforcement plate 6 of the filter bag 7 is inserted into the guide element 3 to the installed position, a corresponding cam 21 is engaged by the inserted end 10 and rotates the control shaft 19 (to the position shown in FIG. 3) so that a cam 22 is positioned for closing of the cover 2. Engagement of cam 21 to the position of FIG. 3 causes clock-wise rotating of the shaft 19 (when viewed from above) against the biasing of the return spring 20. If the closing movement of the cover 2 is executed in the absence of the reinforcement plate 6 of the filter bag 7, or if the reinforcement plate 6 of the filter bag 7 is missing, the cam 22 impacts a corresponding aligned portion of the filler tube 13, such as a tab, fin or the like, to prevent rotation of the control shaft 19 to the position as shown in FIG. 3.

2. The control element 4 can only be adjusted if the filter bag 7 with the reinforcement plate 6 has been inserted, and the cover 2 is closed on the housing 1. Otherwise, the cam 23 prevents the adjustment. By inserting the reinforcement plate 6, the initial rotation of the control shaft 19 occurs, as seen in FIG. 3, but the cam 23 does not yet release the corresponding lock 24 and thus prevents the upward movement of the guide element 3 relative to the cover 2.

Only when the cover 2 is installed on the housing 1 is a further rotation of the control shaft 19 (in a clock-wise direction when viewed from above) performed by means of the cam 22 as it is cammed past the corresponding aligned portion of the filler tube 13. Consequently, the cam 23 releases the corresponding lock 24 to allow the upward movement of the guide element 3. Only then can the activator element 4 be adjusted, to raise the guide element 3 and push the reinforcement plate 6 with its filler opening 14 over the filler tube 13.

3. The cover 2 is locked to the housing 1 by the upward movement of the guide element 3. As a result of this movement, the locking lugs 16 located on the reinforcement plate 6 are pushed behind the brackets 17 located on the cover 2. With the cover 2 rigidly connected with the reinforcement plate 6 and the reinforcement plate again engaged over the filler tube 13, the cover 2 is locked on the housing 1.

Figure 4:
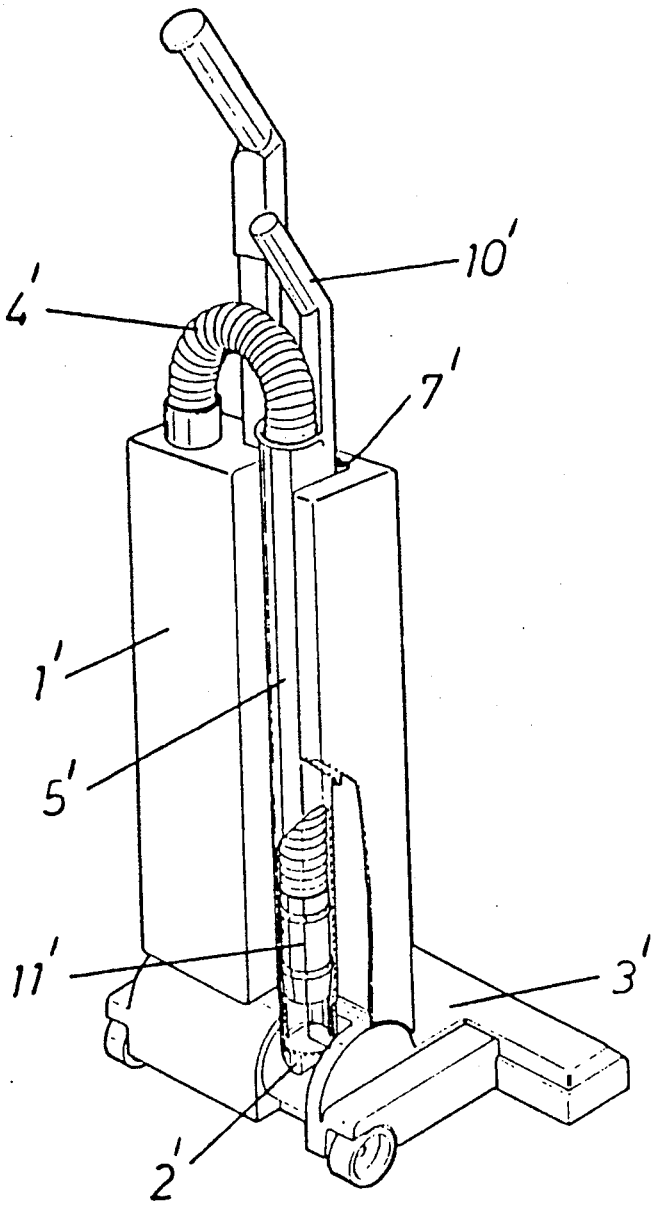
FIG. 4 shows an overall view of an upright brush-type vacuum cleaner for floor cleaning operations.
Figure 5:
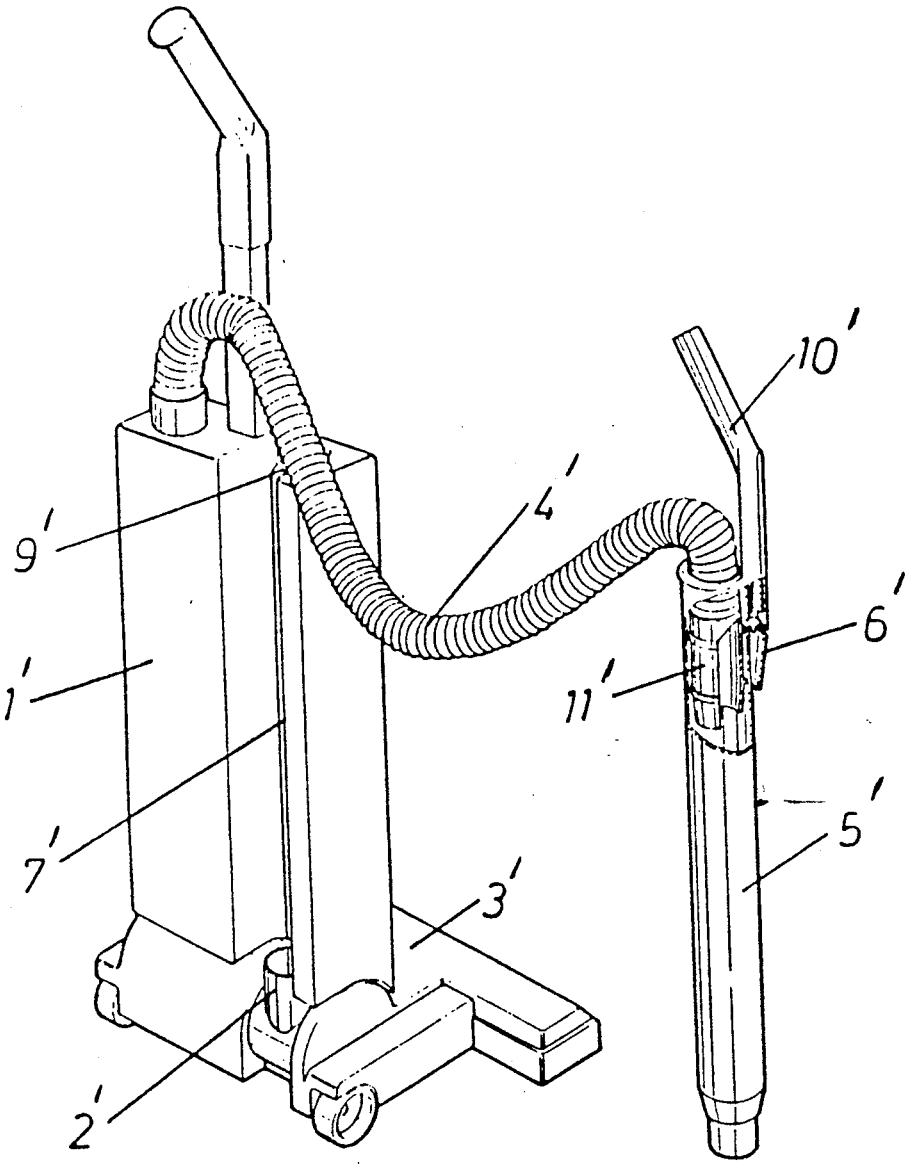
FIG. 5 shows a brush-type vacuum cleaner for auxiliary vacuuming operations with the hand-held vacuum tube.
Figure 6:
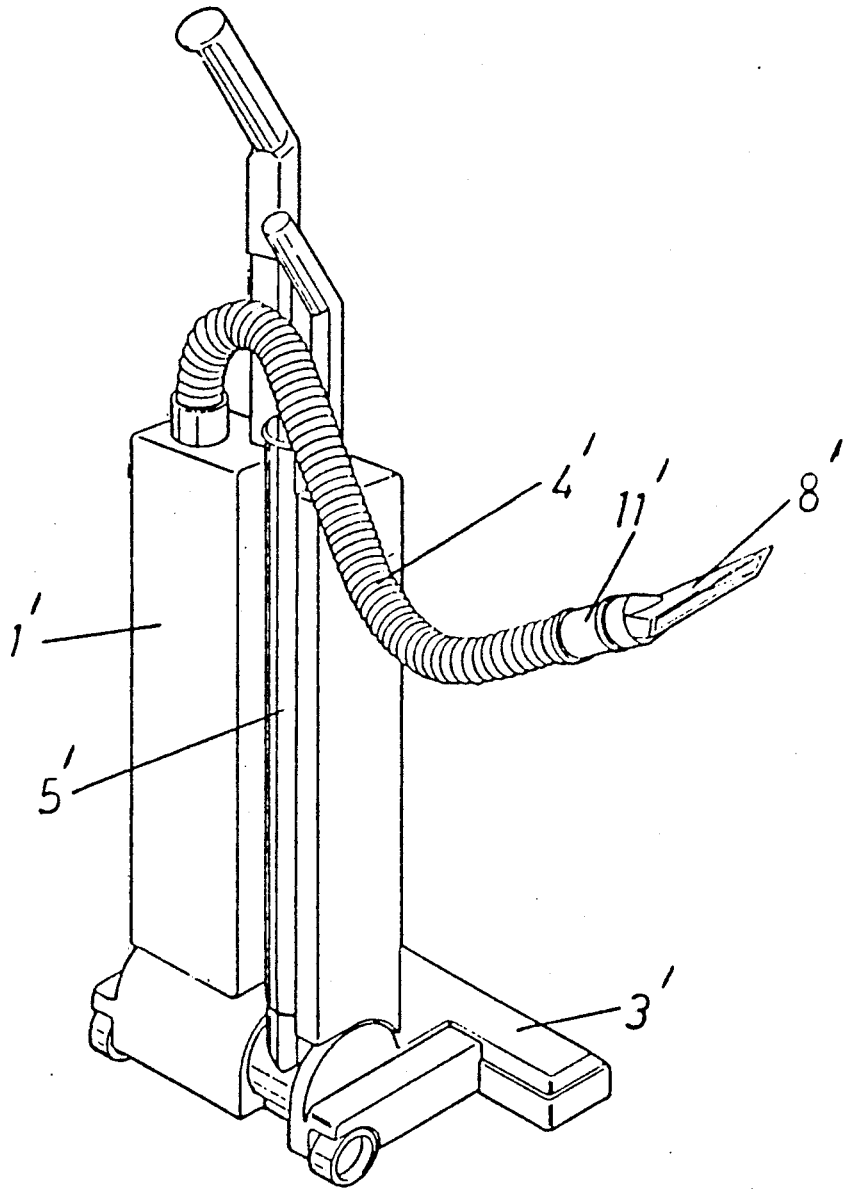
FIG. 6 shows an upright brush vacuum cleaner for auxiliary vacuuming operations with a hand-held vacuum hose, which is separated from the vacuum tube, with a working nozzle installed thereon.
Figure 7:
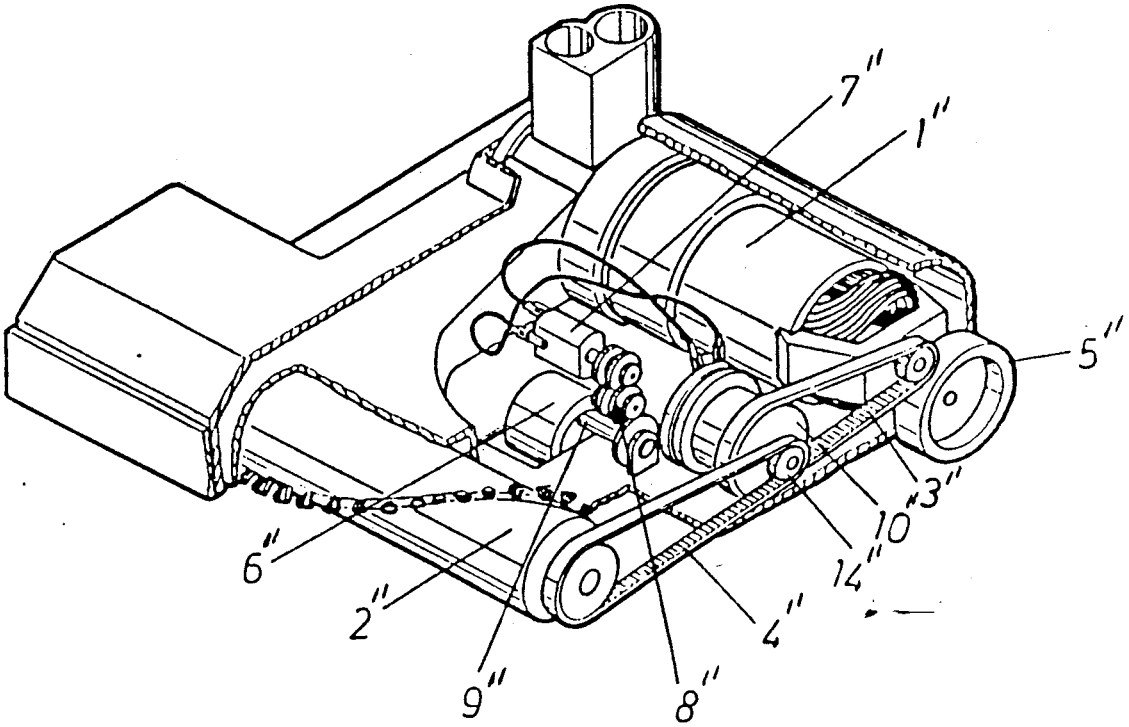
FIG. 7 shows a brush set in a perspective view.
Figure 8:
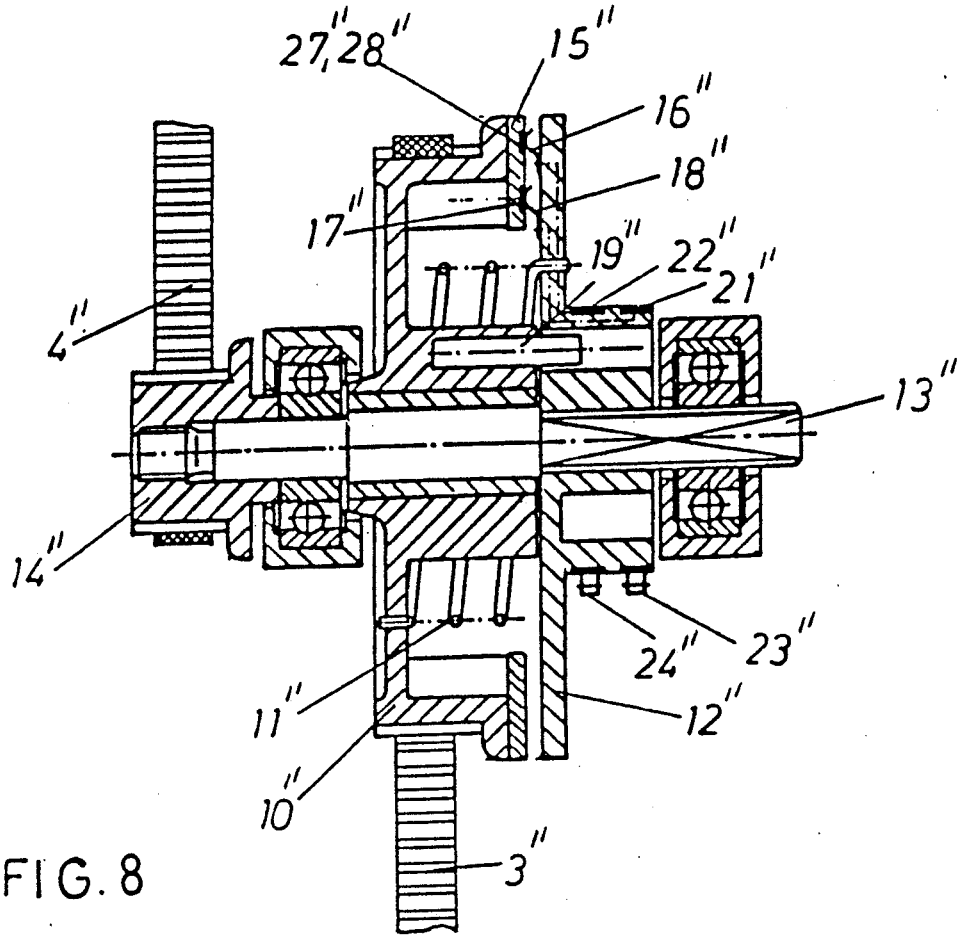
FIG. 8 shows a cross section of a torque measurement and comparison apparatus with a spring.
Figure 9:
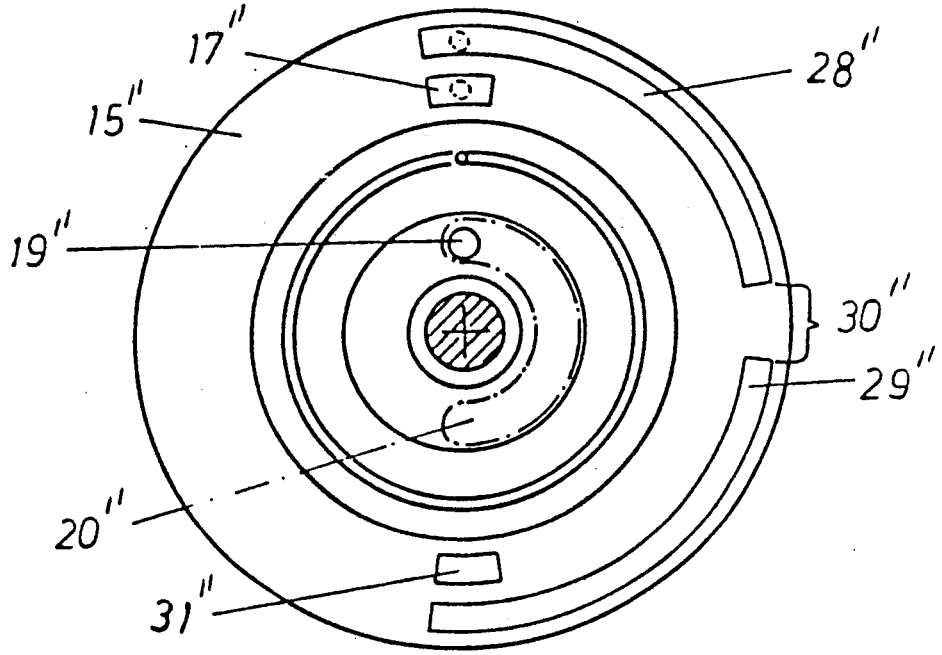
FIG. 9 shows a side view of a belt pulley, which is simultaneously designed as a cam disc with electrical contact rails.

The upright brush-type vacuum cleaner illustrated in FIGS. 4, 5 and 6 comprises a housing 1' with a handle which is designed as the filter cassette for a filter bag. In the lower portion there is a brush set 3' which is connected via a nozzle linkage 2' with a suction nozzle and can be rolled along the floor by means of corresponding wheels.

Connected to the upper portion of the housing 1' is the first end of a hand-held vacuum hose 4', which is supplied with working air by means of the suction nozzle. The hand-held vacuum hose 4' is detachably coupled with a hand-held vacuum tube 5'. As best seen in FIG. 5, the end of the hand-held vacuum hose 4' with a vacuum mouthpiece 11' as a second end thereof connected via a detachable catch 6' with the corresponding end of the hand-held vacuum tube 5'. As seen in FIG. 4, the hand-held vacuum tube 5' can be inserted in a recess 7' in the housing and is thereby connected at the lower end thereof with the nozzle linkage 2' leading to the vacuum nozzle. The hand-held vacuum tube 5' is thereby used as a storage site for the telescoping hand-held vacuum hose 4', located in the hand-held vacuum tube 5'. The external portion of the hand-held vacuum hose 4' is thereby significantly shortened for normal floor vacuuming, which reduces vacuum losses and does not interfere with the operation of the machine. For floor vacuuming operation, in this position, a substantial portion of the hand-held vacuum hose 4' is disposed within the tube 5' and acts as an ascending line for the working air laden with dirt.

On the other hand, in the extended position of the hand-held vacuum hose 4' illustrated in FIG. 5, auxiliary vacuuming operations can be conducted over a large radius of action by means of the resulting extension of the hose 4' and the hand-held vacuum tube 5' which serves as a further extension. When the hand-held vacuum hose 4' is pulled out, it is fastened with its vacuum mouthpiece 11' on the end of the hand-held vacuum tube 5' by means of the catch 6, to prevent the hand-held vacuum tube 4', with its vacuum mouthpiece 11', from being sucked back in during operation. The catch 6' may be a pivoted member which is normally biased inwardly to extend into the interior of the tube 5' through an opening in the side wall thereof. The inward end of the catch can be notched or grooved to align with and engage raised portions on the mouthpiece 11' to prevent its insertion into or extraction from the tube 5'.

For special auxiliary vacuuming operations, the vacuum mouth-piece 11' of the hand-held vacuum hose 4' is removed from the handheld vacuum tube 5' by moving the catch 6' against the biasing to release the mouthpiece 11'. As shown in FIG. 6, the vacuum tube 5' is replaced by appropriate slip-on operating nozzles 8'.

With the mouthpiece inserted in the tube 5', the catch 6', when the hand-held vacuum tube 5' is inserted in the housing 1', is unlocked by an edge 9', and thus the manual vacuum hose 4' can be removed. The edge 9' can include a camming surface which acts on the lower end of the catch 6' to cause it to move outwardly against the biasing. To improve handling, the hand-held vacuum tube is extended by means of a handle 10'.

After the auxiliary vacuuming operations have been completed, the vacuum mouthpiece 11' is inserted or screwed back into the hand-held vacuum tube 5', which is located in the recess 7' in the housing 1'. Again, the edge 9' prevents the catch from engaging and entrapping the mouthpiece 11' at the outer end of the tube 5'. When the fan motor is running, the hand-held vacuum hose 4' is automatically retracted by the underpressure in the hand-held vacuum tube 5', until the vacuum mouthpiece 11' assumes the position indicated in FIG. 4.

The brush set as illustrated in FIGS. 7, 8, 9, 10 and 11 holds a fan motor 1", which simultaneously drives a brush roller 2" by means of toothed belts 3" and 4". The entire brush set is supported on the floor by means of two rear wheels 5" and one front wheel 6". The height of the wheel 6" can be adjusted, so that consequently the height of the brush roller 2" with its bristles can also be adjusted to the carpet pile to be cleaned. To adjust the wheel 6" there is a servomotor 7", which acts by means of a transmission 8" on the wheel 6". The wheel 6" is mounted by means of a cam 9", so that a large change in height can be effected by means of small actuator movements.

To make an adjustment to the floor to be cleaned, taking the carpet pile into consideration, the torque to be transmitted to the brush roller 2" is kept constant, and an adjustment of the wheel 6" is made accordingly.

For this purpose, the toothed belt 3", which is used as the drive, is guided over a belt pulley 10", and the drive power of the motor is transmitted with the interposition of a spring 11" tuned to the torque specified for the brush roller. The additional transmission of the drive movement takes place via a cam disc 12", which is attached by a keyed connection to a shaft 13". A belt pinion 14", which is mounted on the shaft 13", in turn drives the brush roller 2" via a belt 4". One end of the belt pulley 10" is designed as a cam disc 15" with electrical contact rails 28" and 29". The electrical contact rails 28" and 29" are used to generate an actuating signal to raise and lower the wheel 6", while an interrupted area 3.0" between the contact rails 28", 29" signals the correct adjustment of the wheel 6". For this purpose, the cam disc 15" has an associated cam disc 12", which supports a corresponding sliding contact 16" and is oriented in relation to the contact rails 28" and 29".

The cam disc 15" has an additional contact rail 31", which is oriented in relation to a sliding contact 18" of the cam disc 12". The contact rail 31" causes a disconnection of the fan motor 1" if the brush roller 2" is blocked. A bolt 19" on the belt pulley 10" is engaged in a groove 20" of the cam disc 12". The groove 20" is sized to correspond to the angle of rotation for the height adjustment.

If an overload is caused by a blocking of the brush roller 2" or excessive torque, the cam disc 12" rotates to the stop of the bolt 19", at which the sliding contact 18" is located on the contact rail 31", and the fan motor is shut off. The sliding contacts 16" and 18" are connected with corresponding sliding rails 21", 22". As a result, the signals are transmitted via corresponding contacts 23", 24", and are conducted as actuating signals to a control circuit.

The torque produced by the brushes can become increasingly smaller because of bristle wear, and a readjustment by retracting the wheel is no longer possible. When the wheel has reached its limit position, the sliding contact 18" reaches the sliding rail 17", and a signal is given to replace the brushes.

The spring 11" should be tuned to the torque to be transmitted for an optimal operation of the brush roller 2". The turning of the spring 11" should hold the cam discs 12", 15", in the presence of this torque, in an orientation so that the sliding contact 16" is in the area 30" between the contact rails 28" and 29".

When the cam discs 12", 15" are relatively rotating in the vicinity of the contact rail 28", the torque taken from the brush roller 2" is too low. Consequently, the brush roller 2" must be lowered, since it is not digging deeply enough into the carpet pile. In such a case, by means of the contact rail 28", the sliding contact 16", the sliding rail 21" and the contact 23", an actuating signal is generated for the servomotor 7" to retract the wheel 6" and thus lower the brush roller 2". This reaction will continue until the specified torque is reached, and the sliding contact 16" is once again in the area 30" between the contact rails 28" and 29".

When changing to a carpet with a longer pile, a higher torque necessarily occurs, since the brush roller 2" sinks deeper into the carpet. The corresponding cam discs 12", 15" are thereby rotated by means of the interposed spring 11" so that the sliding contact 16" is in the vicinity of the contact rail 29". As a result, corresponding actuating signal is generated for the servomotor 7" to extend the wheel 6", so that the brush roller 2" is raised and the specified torque is again reached.

In practice, the torque on the brush roller 2" can be sharply increased by foreign objects sucked in, such as scraps of paper and string. In such a case, the cam discs 12", 15", rotate opposite one another until the bolt 19" encounters the stop at the end of the groove 20", and the sliding contact 18" would be located on the sliding rail 31", whereupon the fan motor 1" would be disconnected.

So that the machine is not turned off when short-term changes in torque occur during operations, e.g. changes in the direction of movement, the preferred control system includes a delay circuit, to guarantee smooth operation.

Figure 10:
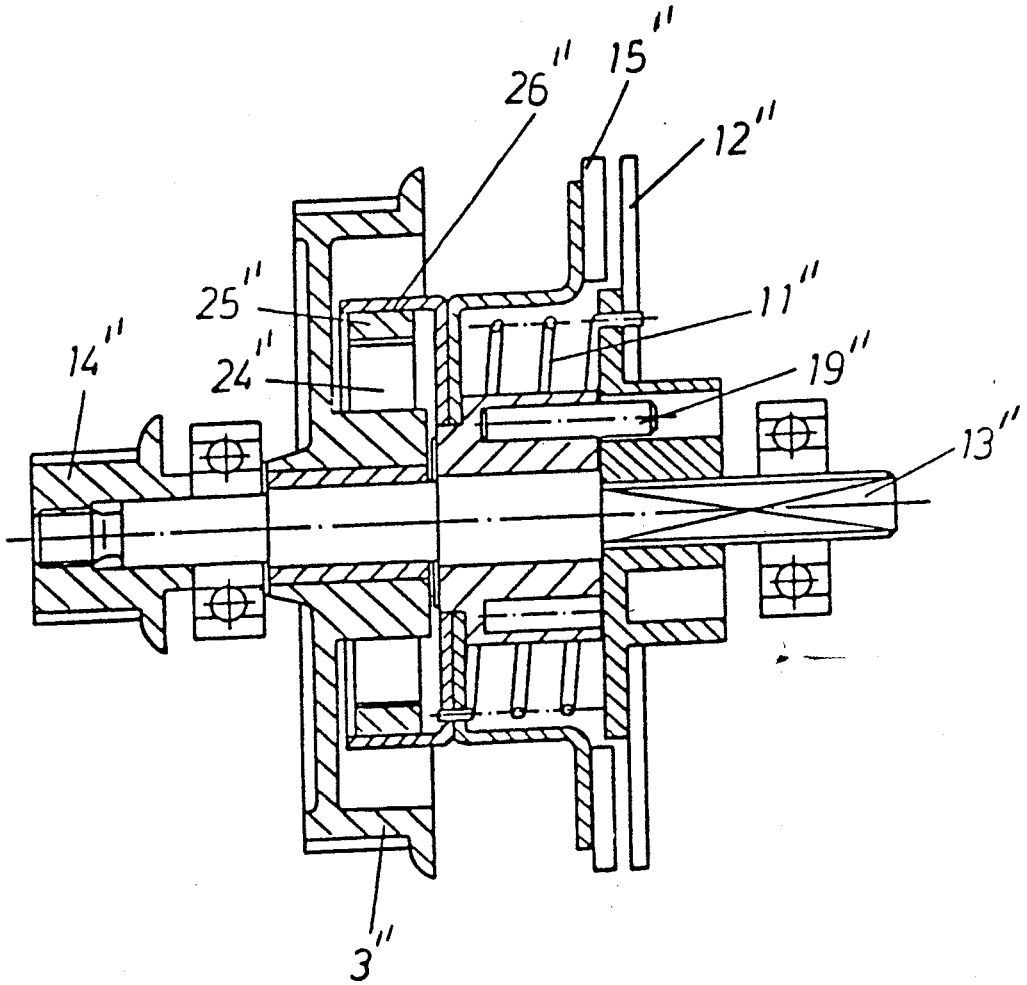
FIG. 10 shows an alternative embodiment of an adjustment apparatus with a slip coupling.

In the alternative embodiment illustrated in FIG. 10, a slip coupling is installed parallel to the spring 11''. For this purpose, springs 24'' are connected to the belt pulley 10'' and have brake linings 25''. The brake linings 25'' transmit the torque to the brush roller 2'' through a corresponding brake drum 26'' associated with the cam disc 15''. The tension of the springs 24'' is thereby set to a maximum torque. When there is an extreme increase in the torque, or if the brush roller is blocked, the brake linings 25'' slide in the brake drum 26'', and no damage occurs to the drive system.

Figure 11:
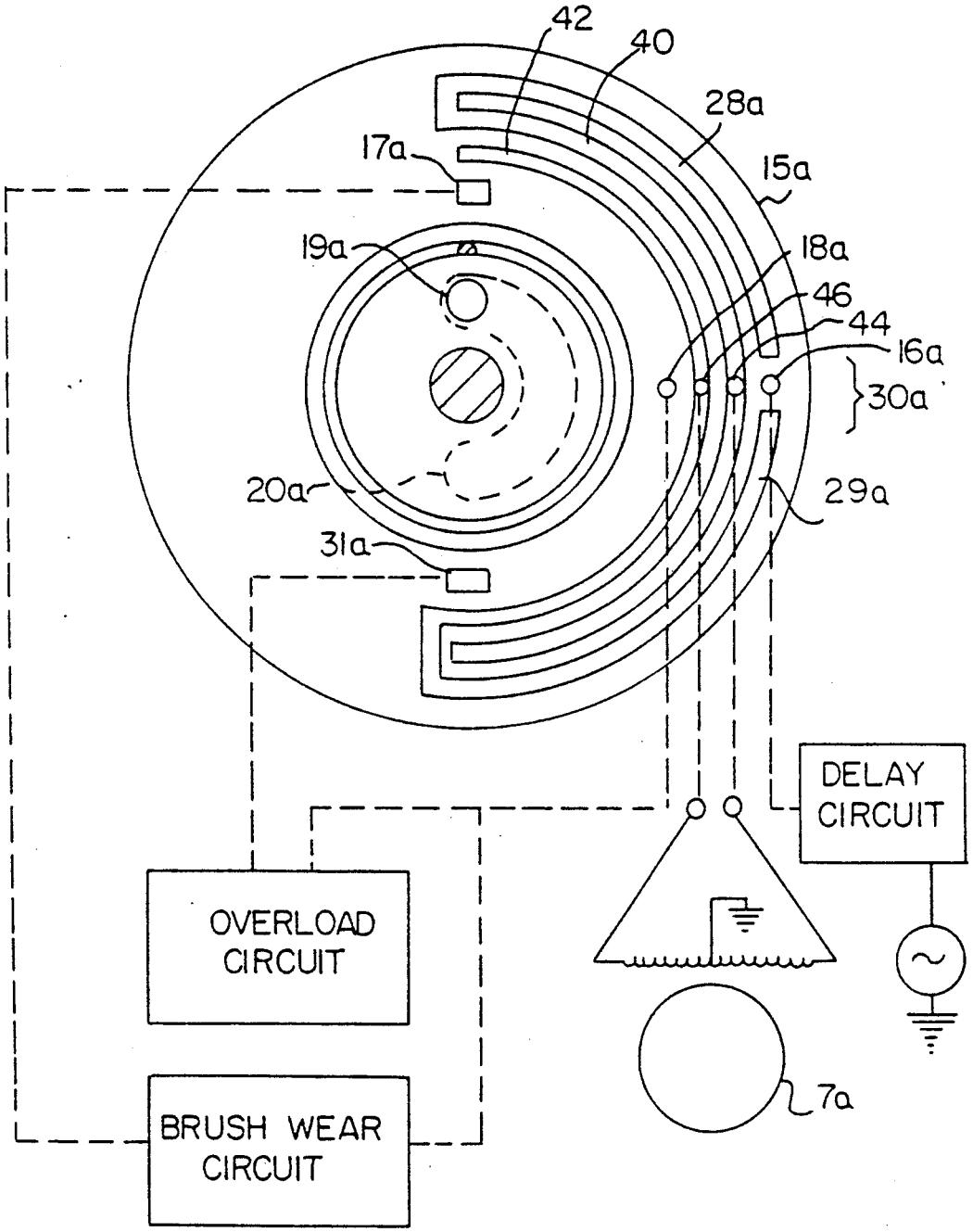
FIG. 11 shows a side view of a belt pulley including an alternative cam disc configuration and a schematic representation of other features of the invention.

As seen in FIG. 11, an alternative disc configuration includes contact rails **28*a* and 29*a* which are similar to contact rails 28'' and 29'' discussed hereinabove. Additionally, an interrupted area 30*a* provides the same function as did the interrupted area 30'' discussed above. For this configuration, the sliding contact 16*a* is again aligned with the contact rails 28*a* and 29*a* for operation of the servomotor represented by the rotor 7*a***.

In order to connect the contact rails **28*a* and 29*a* respectively to the windings of the servomotor of 7*a*, the contact rail 28*a* is electrically connected at the ends thereof to a semi-circular contact rail 40 while the contact rail 29*a* is electrically connected at the ends thereof to a semi-circular contact rail 42. With associated sliding contacts 44 and 46 respectively mounted on the other cam disc (not shown) in the same manner as the sliding contacts 16*a* and 18*a*, a current can be transferred through corresponding sliding rails on the other cam disc which are similar to sliding rails 21'', 22'' which are electronically connected to the sliding contacts 16'' and 18'' in the embodiment shown in FIG. 2. Consequently, current passing through the contact rails 40 and 42 and associated sliding contacts 44 and 46 are capable of providing appropriate current to the windings of the servomotor 7*a*** for either raising the height of the wheel or lowering the height of the wheel in the same manner as discussed hereinabove.

Additionally, as seen in FIG. 11, the sliding contacts **16*a*, 18*a*, 44 and 46 are shown in the position of preferred torque so that the contact 18*a* is not aligned with either of the contact rails 17*a* and 31*a* which are similar to the contact rails 17'' and 31'' as discussed hereinabove. Again, as discussed hereinabove, when sliding contact 18*a* is aligned with the contact rail 31*a* an overload condition will be transmitted to the overload circuitry for turning the fan motor off. In a similar manner, when the sliding contact 18*a* is aligned with the contact rail 17*a***, a signal will be transmitted to the brush wear circuitry to indicate that the brush roller should be replaced.

As also seen in FIG. 11, upon initial activation of the fan motor, the torque applied to the brush roller will not be in a stabilized condition. Accordingly, the power to the sliding contact 16'' can be temporarily interrupted by a delay circuit to allow stabilization of the torque prior to any indication of whether the wheel should be raised or lowered in response to the torque on the brush roller.

It should be clear that the alternative embodiment shown in FIG. 11 includes the various features of the invention as included in the embodiments discussed hereinabove but in a different form.

In summary, the invention includes an apparatus to hold a filter bag in a vacuum cleaner with a dust chamber closed by a cover which can be pivoted or removed. The filter bag has a reinforcement plate which has a filler opening for receipt of a filler tube therein. The reinforcement plate 6 of the filter bag 7 can be inserted in a guide element 3 located on the cover 2. The guide element 3 can be adjusted from outside when the cover 2 is closed so that it slides by means of a control element 4 to guide the filler tube 13 into the filler opening 14 of the reinforcement plate 6. The reinforcement plate 6 has locks 16 which can be locked by means of corresponding abutments 17 on the cover 2 during the adjustment and insertion of the filler tube 13 into the filler opening 14 of the reinforcement plate 6.

The apparatus is also characterized by the fact that the guide element 3 has mounting rails 8 for the lateral mounting of the reinforcement plate 6 of the filter bag 7.

The guide element 3 may have recesses 12 designed to hold corresponding catches 11 on the inserted end 10 of the reinforcement plate 6 of the filter bag 7.

The abutments for the locks 16 of the reinforcement plate 6 of the filter bag 7 can be formed by brackets 17 on the cover 2.

The apparatus may be characterized by the fact that, in the guide element 3, there is a control shaft 19 having cams 21, 22, 23 and held by a return spring 20. The cam 21 rotates the control shaft by means of the inserted reinforcement plate 6 so that a locking cam 22 releases the closure of the cover 2. During the closing of the cover 2 by means of a control edge, there is an additional rotation of the control shaft 19 to release a lock 23, 24 of the control element 4 for an adjustment of the guide element 3.

The invention as described hereinabove in the context of preferred embodiments is not to be taken as limited to all of the provided details thereof, since modifications and variations thereof may be made without departing from the spirit and scope of the invention.

What is claimed is:

1. A vacuum cleaner comprising:

a housing having a lower portion including wheels for movement along a floor;

said housing having handle means for producing said movement of said vacuum cleaner along the floor;

said housing having a displaceable cover;

said cover for being displaced to a closed position on said housing for defining a dust chamber therein;

air suction means in said housing for drawing air into said dust chamber;

said housing having a filler tube for supply of the air to said dust chamber;

said filler tube having an end disposed within said dust chamber;

a filter bag having a reinforcement plate for installation within said dust chamber;

said reinforcement plate having a filler opening for receiving said end of said filler tube therein;

said cover having an interior wall;

a guide element mounted on said interior wall for movement toward and away from said end of said filler tube when said cover is in said closed position;

said reinforcement plate for being selectively installed on said guide element; and said guide element, with said installed reinforcement plate positioned thereon, having means for effectuating said movement of said guide element toward said end of said filler tube when said cover is in said closed position to cause receipt of said end of said filler tube in said filler opening of said reinforcement plate.

2. The vacuum cleaner according to claim 1, further including retention means for retaining said reinforcement plate in said installed position on said guide element.

3. The vacuum cleaner according to claim 1, further including interlocking means between said cover and said reinforcement plate for maintaining said cover in said closed position when said filler tube is installed in said filler opening.

4. The vacuum cleaner according to claim 1, wherein said guide element has mounting rail means extending outwardly of said interior wall of said cover, said reinforcement plate includes alignment means for alignment with said mounting rail means, and said alignment means are mounted on said mounting rail means for the selective installation of said reinforcement plate on said guide element.

5. The vacuum cleaner according to claim 4, wherein said alignment means are mounted for movement on said mounting rail means in a direction toward said cover to said installed position thereon.

6. The vacuum cleaner according to claim 1, further including means for determining that said reinforcing plate is in said installed position.

7. The vacuum cleaner according to claim 6, further including means for determining that said cover is in said closed position.

8. The vacuum cleaner according to claim 7, further including means for preventing said movement of said guide element toward said end of said filler tube unless said reinforcing plate is in said installed position and said cover is in said closed position.

9. The vacuum cleaner according to claim 8, wherein said means for determining when said reinforcement plate is in said installed position includes a first cam for engagements with said reinforcing plate, said reinforcing plate for rotating said first cam, said means for determining when said cover is in said closed position is a second cam for engagement with said cover, said cover for rotating said second cam, said means for preventing said movement is a third cam displaceable when said second cam engages said cover, and said first cam, said second cam and said third cam being disposed on a control shaft, said control shaft being mounted for rotation against biasing on said guide element.

10. The vacuum cleaner according to claim 6, wherein said means for determining that said reinforcing plate is in said installed position also comprises means for preventing said cover from being in said closed position unless said reinforcement plate is in said installed position.

11. A vacuum cleaner comprising:

a housing having a lower portion including wheels for movement along a floor;

said housing having handle means for producing said movement of said vacuum cleaner along the floor;

said housing having a displaceable cover;

said cover for being displaced to a closed position on said housing for defining a dust chamber therein;

air suction means in said housing for drawing air into said dust chamber;

said housing having a filler tube for supply of the air to said dust chamber;

said filler tube having an end disposed within said dust chamber;

a filter bag having a reinforcement plate for installation within said dust chamber;

said reinforcement plate having a filler opening for receiving said end of said filler tube therein;

said cover having an interior wall;

a guide element mounted on said interior wall for movement toward and away from said end of said filler tube when said cover is in said closed position;

said reinforcement plate for being selectively installed on said guide element;

said guide element, with said installed reinforcement plate positioned thereon, having means for effectuating said movement of said guide element toward said end of said filler tube when said cover is in said closed position to cause receipt of said end of said filler tube in said filler opening of said reinforcement plate;

interlocking means between said cover and said reinforcement plate for maintaining said cover in said closed position when said filler tube is installed in said filler opening;

said guide element having mounting rail means extending outwardly of said interior wall of said cover;

said reinforcement plate including alignment means for alignment with said mounting rail means;

said alignment mean being mounted on said mounting rail means for the selective installation of said reinforcement plate on said guide element; and means for preventing said movement of said guide element toward said end of said filler tube unless said reinforcing plate is in said installed position and said cover is in said closed position.

12. Apparatus for mounting a filter bag in a vacuum cleaner comprising:

a housing having a displaceable cover;

said cover for being displaced to a closed position on said housing for defining a dust chamber therein;

said housing having a filler tube for supply of the air to said dust chamber;

said filler tube having an end disposed within said dust chamber;

said filter bag having a reinforcement plate for installation within said dust chamber;

said reinforcement plate having a filler opening for receiving said end of said filler tube therein;

said cover having an interior wall;

a guide element mounted on said interior wall for movement toward and away from said end of said filler tube when said cover is in said closed position;

said reinforcement plate for being selectively installed on said guide element; and said guide element, with said reinforcement plate positioned thereon, having means for effectuating said movement of said guide element toward said end of said filler tube when said cover is in said closed position to cause receipt of said end of said filler tube in said filler opening of said reinforcement plate.

13. The vacuum cleaner according to claim 9, further including a control element pivotally mounted on said cover, said control element passing through said cover and said control element having an inner end pivotally connected to said guide element and an outer end, said outer end being for external adjustment of said guide element within said dust chamber with said cover in said closed position.

14. The vacuum cleaner according to claim 13, further including retention means for retaining said reinforcement plate in said installed position on said guide element, said retention means including catch means disposed on said reinforcement plate and recess means disposed on said guide element, said recess means being for receipt and for retention of said catch means.

15. The vacuum cleaner according to claim 14, further including interlocking means between said cover and said reinforcement plate for maintaining said cover in said closed position when said filler tube is installed in said filler opening, said interlocking means including abutment means disposed on said reinforcement plate and bracket means disposed on said cover, said bracket means being for receipt and for locking of said abutment means.

* * * * *